US005395234A

United States Patent [19]

Gutierrez

[11] Patent Number: 5,395,234

[45] Date of Patent: Mar. 7, 1995

[54] POSITIVE OIL CANDLE WICK MOVEMENT MECHANISM

[76] Inventor: John P. Gutierrez, 1041 Lau Hala, Vista, Calif. 92083

[21] Appl. No.: 206,628

[22] Filed: Mar. 7, 1994

[51] Int. Cl.[6] ..... F23D 3/28

[52] U.S. Cl. ..... 431/315; 431/317; 431/324

[58] Field of Search ..... 431/315, 324, 304, 320, 431/241, 326, 344, 316–318, 305–308, 323, 319

[56] References Cited

U.S. PATENT DOCUMENTS

| | | | |
|---|---|---|---|
| 3,158,015 | 11/1964 | Renwick, Sr. et al. | 431/315 |
| 3,236,072 | 2/1966 | Goldszmid | 431/315 |
| 3,457,021 | 7/1969 | Gladden et al. | 431/315 |
| 3,734,682 | 5/1973 | May | 431/315 |

*Primary Examiner*—James C. Yeung
*Attorney, Agent, or Firm*—John J. Murphey

[57] ABSTRACT

A positive oil candle wick advancing and retracting mechanism including a candle cap having formed therethrough an elongated bore for passage of the wick, at least three elongated tubular elements mounted in the cap immediately below the bore for rotational movement in close equiangular arrangement about a central axis passing upward through the bore, a series of spiral threads formed along the greater length of the outside surface of the elements to engage the wick uniformly thereabout, a series of outwardly facing gear teeth formed circumferentially about a shorter length of the outside surface of the elements spaced apart from the spiral threads, and a candle cap support base including a first mechanism for retaining the candle cap in aligned rotational position thereon, a second mechanism for attaching the base to a candle oil receptacle, and a series of inwardly facing gear teeth formed in a circumferential ring about the interior of the base and arranged for engagement with the outwardly facing gear teeth of the tubular elements so that rotational movement of the candle cap with respect to the base causes the tubular elements to rotate in unison against the wick causing the spiral threads to advance the wick upward and retract it downward through the bore.

20 Claims, 2 Drawing Sheets

POSITIVE OIL CANDLE WICK MOVEMENT MECHANISM

BACKGROUND OF THE INVENTION

1. Field of the Invention

This invention relates to the field of candles. More particularly, it relates to mechanisms for advancing and retracting the wick of an oil candle, of the type where combustible oil in a receptacle is drawn by surface tension forces up the wick and burned above a metal candle cap.

2. Description of the Prior Art

Burning oily substances for heat and light has been around for centuries. Bees wax and animal tallow have been formed into candles and burned through a wick fixedly positioned therein; another type of candle, the oil candle or oil lamp, with its moveable wick, has been part of history for almost as long. It was the oil lamp that held the genie in the story of Aladdin of The Arabian Nights, a collection of ancient tales from the Mideast.

In the use of oil lamps and oil candles (they appear to be synonymous) it is important to control the position of the wick. Too short a wick does not permit sufficient area for burning the oil and the light is too dim. Too long a wick permits too much an area and the flame is overly large and can cause the flame to generate smoke. While there may be no such thing as too much light, too large a flame creates a safety hazard and could result in disaster.

Wax and tallow candles burn at a rather controlled rate, determined by the length of the wick fixedly positioned in the combustible material. On the other hand, oil burning candles and lamps are desired for the controllable light they emit; this coming from the control of the length of the wick by mechanical means.

The simplest form of wick control is by the use of one's fingers; i.e., one merely pulls the wick up from the wick bore in the top or side of the candle. If too much wick is pulled up the excess is either pushed back down or cut off. While this may be acceptable practice where there is no flame, it becomes a fairly unsafe practice if the wick is already on fire. Further, trying to grasp enough of a burned-down wick to pull up a length of it often is an exasperating undertaking resulting in broken finger nails and shortened tempers.

The prior art has dealt with this problem by fashioning a wheel or a pair of rollers to engage the wick and providing a stem extending therefrom to twist from outside the candle. Twisting the stem either rotates .the wheel which bears against one side of the wick or rotates the rollers to push the wick upward or pull it downward. These mechanisms have a common shortcoming in that only one side or at most two sides of the wick are contacted. An oily soaked wick is a slippery item and often slips by the wheel or through the rollers. In addition, the wick is quite limp and often develops kinks and knots that jam in these movement mechanisms. It appears these problems are exacerbated by the fact that the prior art mechanisms have a fairly narrow area of contact with the wick. Further, these control mechanisms are often positioned in the line of sight of the wick burn area. Exposure of these controls to the bright flame causes .them to become coated with soot often causing jamming and/or drawing the temper from the metal so that the mechanism becomes weak and easily broken.

SUMMARY OF THE INVENTION

This invention solves the problems heretofore described in the prior art. It comprises a series of at least three tubular elements mounted inside the candle cap that have spiral threads formed along a length of their outer surface. They are arranged to contact the wick in equiangular position thereabout just below the wick bore. The threads engage the surface of the wick uniformly thereabout to lessen the development of kinks and knots. A candle cap support base is provided on which the candle cap is rotatably mounted and is connectable to the oil or other combustible liquid receptacle. A series of outwardly facing gear teeth on the lower end of the tubular elements is designed to engage a series of inwardly facing gear teeth arranged in the base to turn the elements, as the cap is turned, to spin and rotate about the wick and advance or retract the wick through the cap bore.

The spinning and rotational movement of the tubular elements maintains the oil soaked wick straight and in full alignment with the bore hole so that continuous positive advance and retract motions are maintained free of kinks, knots and slipages. The device of this invention is termed a "positive" movement mechanism to denote that both the advance and retract operations are with full engagement of the threads, i.e., there is no way to push or pull the wick with one's fingers or for the wick to slip free of the mechanism and move freely through the cap bore.

Accordingly, the main object of this invention is an oil candle wick advancing and retracting mechanism that provides positive control during all movements of the wick in the cap bore. Other objects of the invention include a mechanism that surrounds the wick adjacent the bore to prevent the occurrence of kinks and knots therein; a mechanism wherein positive advance and retraction of the wick may be easily achieved by rotating the candle cap and the candle cap support base in opposite directions; a mechanism that is free from fouling by remaining totally out of sight below the area of burn of the wick; a mechanism that is simple and sturdy in construction and that is constantly lubricated by the combustible oil in the receptacle; and a mechanism that is positioned well below and totally outside the radiation pattern of the candle so as to maintain its strength and remain clear of carbon deposits. Because of the elongated nature of the positive control of the wick, a unique feature of this invention is that it may be used to retract the wick below the cap bore, to snuff out the candle flame, and thereafter advance back up through the bore to place it in position for relighting, all without having to reposition the wick for advancing back through the bore.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENT

Figure 1:
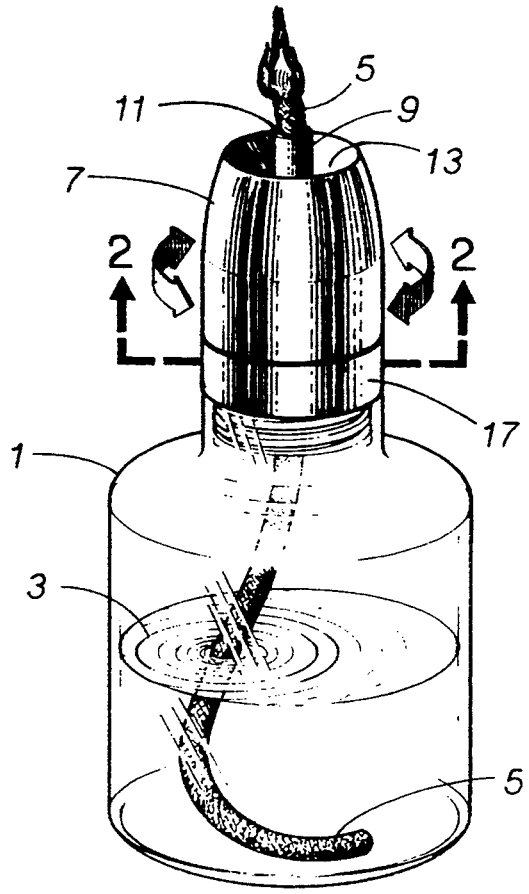
FIG. 1 is a trimetric view of an oil candle utilizing the invention.

Turning now to the drawings wherein like elements are identified with like numerals throughout the three figures, the invention is shown in use with an oil receptacle 1 having a volume of combustible liquid 3 contained therein, such as kerosene, olive oil, mineral oil, and the like, in which a cotton wick 5 is placed to draw oil up through its tubular woven body, by surface tension forces, to be burned at the top as shown. The invention comprises a candle cap 7, positioned atop the candle, having a boss 9 formed at the top thereof and extending upward to provide support for the wick. A vertical bore 11 is drilled through boss 9 for support of wick 5. A small moat 13 is formed at the base of boss 9 to catch any oil that may run down off the wick. An open chamber 15 is formed under cap 7. A candle cap support base 17 is provided between cap 7 and oil receptacle 1.

A plurality, and preferably at least three, elongated tubular elements 19 are provided. Each element has a central bore 21 formed therethrough and is supported for rotational movement on a socket headed shoulder bolt 23 that passes through bore 21 and is threadably received in a flange 25 that forms the base of moat 13. Elements 19 are preferably arranged in equiangular position about the vertical axis of bore 11 and set slightly apart therefrom.

A series of spiral threads 29 are formed outwardly along one portion, and preferably the greater length, of the outside surface 31 of elements 19 and are all arranged to progress from the lower portion on the element upward toward flange 25 in unison, i.e., they are all to be either right-hand or left-hand threads. The purpose of outwardly extending threads 29 is to engage wick 5 uniformly along its length and hold said wick in axial alignment directly below bore 11.

Figure 2:
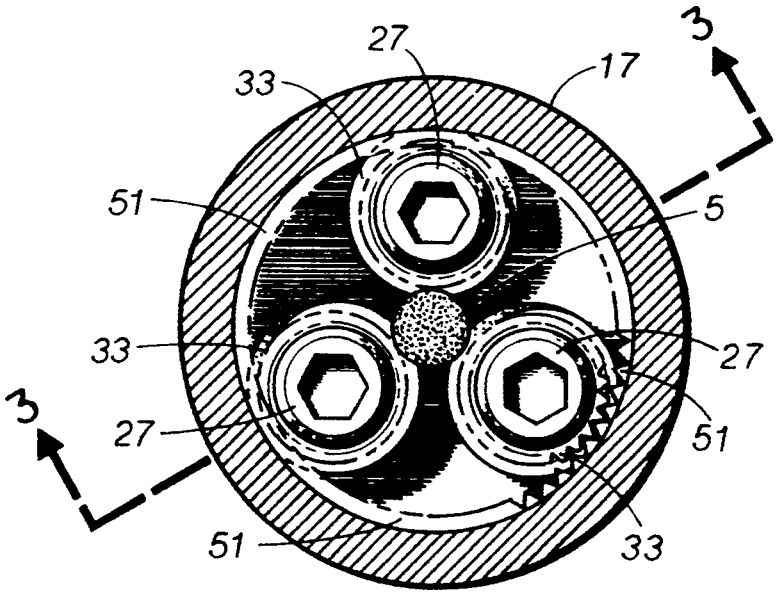
FIG. 2 is a sectional plan view of the underside of the embodiment taken along lines 2—2 in FIG. 1; and, FIG. 3 is a side elevation sectional view of the embodiment taken along lines 3—3 in FIG. 2.

A series of outwardly facing gear teeth 33 are formed circumferentially about the lower portion of elements 19 between the threaded portion and heads 27 of shoulder bolts 23. Teeth 33 are spaced apart from threads 29 and, as shown in FIG. 2, neither the threads nor the gear teeth of any one tubular element is in contact with the threads or gear teeth of any other element. It is preferred that threads 29 extend a greater length of tubular element 19 than gear teeth 33 to provide more control over wick 5. It is also preferred that threads 29 extend further outward from element 19 than do gear teeth 33 so as to allow the threads to engage wick 5 without interference from the gear teeth.

Candle cap support base 17 is positioned below cap 7, in axial alignment therewith, and contains first means 35 for retaining cap 7 in aligned rotational position thereon. Means 35 is shown as an inwardly facing circumferential groove 37 formed around the inside of cap 7 in chamber 15 for receipt therein of the outwardly extending distal ends 39 of a plurality of fingers 41 that extend upward from base 17 and are preferably equiangularly spaced thereabout.

Figure 3:
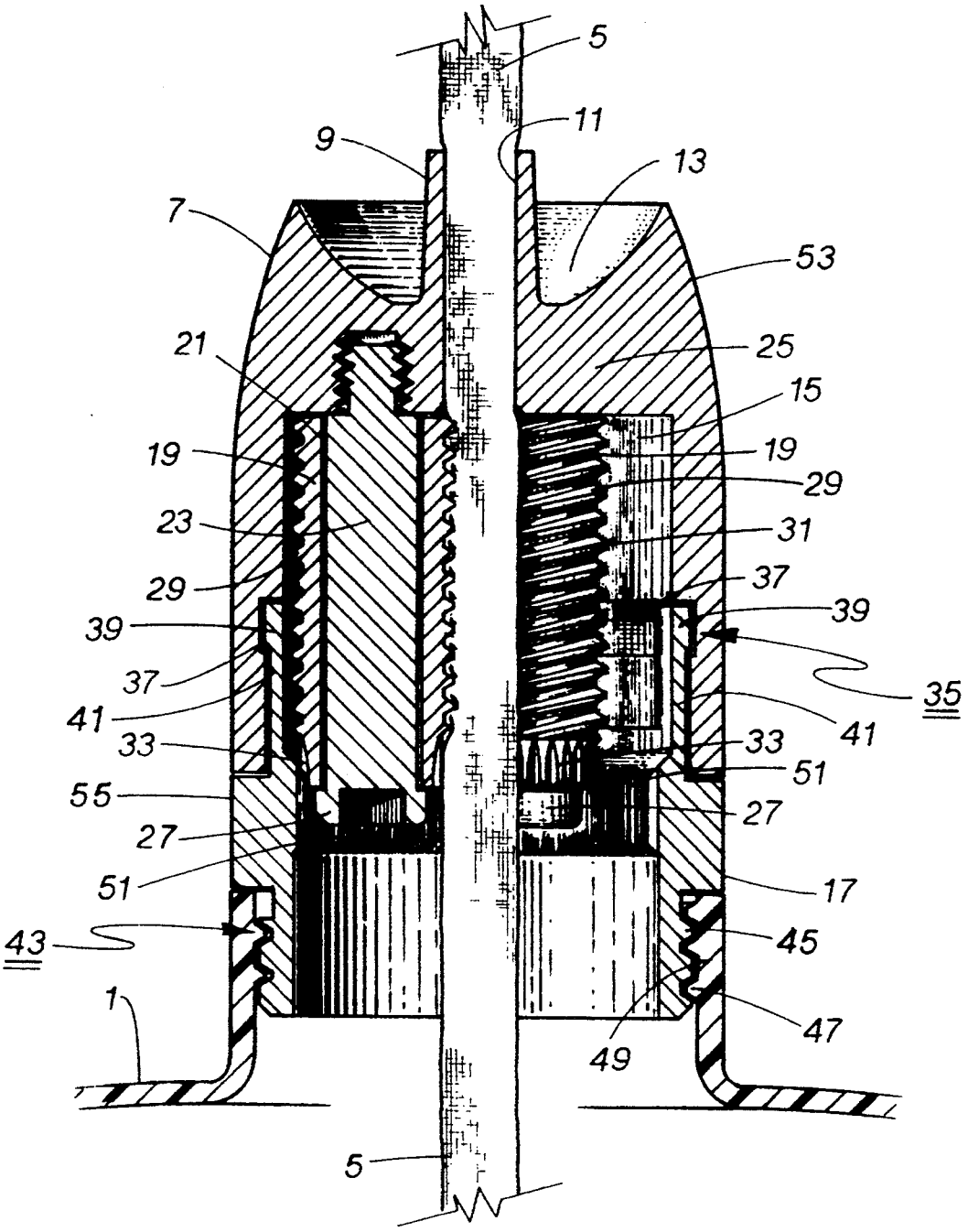

A second means 43 is provided in base 17 for attaching it to oil receptacle 1. Means 43 is shown to comprise a series of outwardly facing threads 45, formed circumferentially thereabout, in the lower part of base 17 for threaded mating with a like series of inwardly facing threads 47 formed at the top or neck 49 of receptacle 1 as shown in FIG. 3.

A series of inwardly facing gear teeth 51 are formed in a circumferential ring about the interior of base 17 for engagement with gear teeth 33 of each tubular element. Rotational movement or twisting of cap 7 with respect to base 17 will cause intermeshing gear teeth 33 and 51 to turn tubular elements 19 in unison and spirally drive wick 5 upward or downward along the axis of bore 11 thereby advancing or retracting wick 5 vis-a-vis cap 7.

With three elements 19 spaced equiangularly about wick 5 the problems with knots and kinks developing in the wick is effectively eliminated. Preferably the outer surfaces 53 and 55 of cap 7 and base 17 are smoothed and lapped to form a continuous surface to develop a pleasing aesthetic look and to hide the fact that cap 7 and base 17 are separate members. Fabricating cap 7 and base 17 from brass or bronze in the contour shown in FIG. 1 makes a most attractive addition to any oil receptacle and a beautiful top to a cylindrical oil receptacle in the form of a candle.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A positive oil candle wick advancing and retracting mechanism comprising, in combination:

a) a candle cap having formed therethrough an elongated bore for passage of the wick;

b) at least three elongated tubular elements mounted in said cap immediately below said bore for rotational movement in close equiangular arrangement about a central axis passing upward through said bore;

c) a series of spiral threads formed along the outside surface of said elements to engage the wick uniformly thereabout;

d) a series of outwardly facing gear teeth formed circumferentially about said outside surface of said elements spaced apart from said spiral threads; and, e) a candle cap support base, comprising:

(1) first means for retaining said candle cap in aligned rotational position thereon;

(2) second means for attaching said base to a candle oil receptacle; and, (3) a series of inwardly facing gear teeth formed in a circumferential ring about the interior of said base and arranged for engagement with said outwardly facing gear teeth of said tubular elements so that rotational movement of said candle cap with respect to said base causes said tubular elements to rotate in unison against the wick causing said spiral threads to advance the wick upward and retract it downward through said bore.

2. The mechanism of claim 1 wherein said spiral threads on said tubular elements are greater in length than said gear teeth.

3. The mechanism of claim 1 including three tubular elements.

4. The mechanism of claim 1 wherein said candle cap and said support base are axially aligned.

5. The mechanism of claim 1 wherein said bore is centrally aligned in said candle cap.

6. The mechanism of claim 1 wherein said spiral threads extend further from the outer surface of said tubular elements than said outwardly facing gear teeth.

7. The mechanism of claim 1 wherein said spiral threads are formed along a greater portion of the outer surface of said tubular elements than are said series of outwardly facing gear teeth.

8. The mechanism of claim 1 wherein said series of outwardly facing gear teeth are set below said spiral threads when said candle cap is set atop said support base.

9. The mechanism of claim 1 wherein said first means includes a series of threads exterior thereof arranged for mating engagement with a like series of threads interior the candle oil receptacle.

10. The mechanism of claim 1 wherein said second means includes a plurality of fingers extending upwardly from said base, and into said cap, terminating in outward extending distal ends, and an inwardly facing annular groove formed in said candle cap for receipt therein of said distal ends.

11. A positive oil candle wick advancing and retracting mechanism comprising, in combination:

a) a candle cap having formed therethrough an elongated bore for passage of the wick;

b) a moat formed in said cap for capture of combustible oils that may run down off the wick;

c) at least three elongated tubular elements mounted in said cap immediately below said bore for rotational movement in close equiangular arrangement about a central axis passing upward through said bore;

d) a series of spiral threads formed along the outside surface of said elements to engage the wick uniformly thereabout;

e) a series of outwardly facing gear teeth formed circumferentially about said outside surface of said elements spaced apart from said spiral threads; and, f) a candle cap support base, comprising:

(1) first means for retaining said candle cap in aligned rotational position thereon;

(2) second means for attaching said base to a candle oil receptacle; and, (3) a series of inwardly facing gear teeth formed in a circumferential ring about the interior of said base and arranged for engagement with said outwardly facing gear teeth of said tubular elements so that rotational movement of said candle cap with respect to said base causes said tubular elements to rotate in unison against the wick causing said spiral threads to advance the wick upward and retract it downward through said bore.

12. The mechanism of claim 11 wherein said candle cap and said support base are axially aligned.

13. The mechanism of claim 11 wherein said bore is centrally aligned in said candle cap.

14. The mechanism of claim 11 wherein said spiral threads are formed along a greater portion of the outer surface of said tubular elements than are said series of outwardly facing gear teeth.

15. The mechanism of claim 11 wherein said first means includes a series of threads exterior thereof arranged for mating engagement with a like series of threads interior the candle oil receptacle, 16. The mechanism of claim 11 wherein said second means includes an inwardly facing annular ring formed on said candle cap and an outwardly facing annular groove formed on said candle cap support base for inter-engagement therewith.

17. The mechanism of claim 11 wherein said second means includes an inwardly facing annular groove formed on said candle cap and an outwardly facing annular groove formed on said candle cap and an outwardly facing annular ring formed on said candle cap support base for inter-engagement therewith.

18. The mechanism of claim 11 wherein said second means includes a plurality of fingers extending upwardly from said base, and into said cap, terminating in outward extending distal ends, and an inwardly facing annular groove formed in said candle cap for receipt therein of said distal ends.

19. The mechanism of claim 11 wherein said spiral threads on said tubular elements are greater in length than said gear teeth.

20. The mechanism of claim 11 wherein said series of outwardly facing gear teeth are set below said spiral threads when said candle cap is set atop said support base.

* * * * *